US006193072B1

(12) United States Patent
Link et al.

(10) Patent No.: US 6,193,072 B1
(45) Date of Patent: Feb. 27, 2001

(54) SIFTING MACHINE WITH AXIAL REMOVAL OF SCREEN, ROTOR, WORM CONVEYOR AND DRIVES FOR CLEANING AND MAINTENANCE

(75) Inventors: Otmar Link, Buchen-Götzingen; Josef Schmitt, Osterburken, both of (DE)

(73) Assignee: AZO GmbH & Co., Osterburken (DE)

( * ) Notice: Subject to any disclaimer, the term of this patent is extended or adjusted under 35 U.S.C. 154(b) by 0 days.

(21) Appl. No.: 09/191,105

(22) Filed: Nov. 13, 1998

(30) Foreign Application Priority Data

Nov. 20, 1997 (DE) ..... 197 51 419

(51) Int. Cl.[7] ..... B07B 1/18

(52) U.S. Cl. ..... 209/286; 209/284; 209/285; 209/240; 209/262; 209/263

(58) Field of Search ..... 209/240, 262, 209/263, 264, 284, 285, 288, 281, 283, 286, 300, 244, 245, 241

(56) References Cited

U.S. PATENT DOCUMENTS 4,236,676 12/1980 Bialski et al. ..... 241/74

*Primary Examiner*—Donald P. Walsh
*Assistant Examiner*—Jonathan R. Miller
(74) *Attorney, Agent, or Firm*—Paul Vincent

(57) ABSTRACT

A sifting machine comprises a stationary sifting basket, a rotor rotating within the sifting basket and a worm conveyor feeding into an end of the sifting basket for dosing and introducing the material to be sifted. The rotor and the worm conveyor are driven for rotation, wherein, in order to achieve an optimal rate of revolution adjusted to the desired mode of operation for both the worm conveyor and the rotor, each has its own drive device. In order to facilitate removal, the unit comprising the rotor, the sifting basket and the associated drive mechanism can be axially removed from the sifting machine housing and subsequently pivoted-out in a sideward direction via a pivot bearing.

8 Claims, 2 Drawing Sheets

SIFTING MACHINE WITH AXIAL REMOVAL OF SCREEN, ROTOR, WORM CONVEYOR AND DRIVES FOR CLEANING AND MAINTENANCE

This application claims Paris Convention Priory of German Patent application number 197 51 419.7 filed Nov. 20, 1997 the complete disclosure of which is hereby incorporated by reference.

BACKGROUND OF THE INVENTION

The invention concerns a sifting machine having a stationary sifting basket, a rotor rotating in the sifting basket and a worm conveyor feeding into an end of the sifting basket for dosing and introducing a material to be sifted, wherein the rotor and the worm conveyor are driven for rotation.

In sifting machines having a stationary sifting basket disposed within a sifting machine housing and having a rotor rotating therein, the material to be sifted is normally introduced by means of a worm conveyor which projects into an end of the sifting basket and transfers the material. The material is engaged by the rotor in the sifting basket and accelerated in a centrifugal fashion against the sifting surface of the sifting basket. The sifted material falls into a receiving hopper and is passed out of the sifting machine housing, whereas the course product is transported out at the end of the sifting basket facing away from the worm conveyor. This is generally effected in that the rotor plates have a slight tilt in the axial direction.

In order to drive the worm conveyor and the rotor for rotation, both seat on a common shaft and one single drive motor is provided for which is disposed on the end of the worm conveyor facing away from the rotor. The amount of material fed to the rotor depends on the rate of revolution of the drive motor and may not exceed certain values to prevent unsifted material from being removed along with the course material discharge. The rate of revolution must also be chosen in such a fashion that a sufficient dwell time in the sifting basket is guaranteed for the material being sifted. The highest degree of sifting efficiency for a sifting machine thereby requires, on the one hand, an optimal rotor rate of revolution for the actual sifting process and, on the other hand, an optimized rate of revolution for the worm conveyor with regard to the introduction of material. Since both rates of revolution are not equal and also depend on the material, it is always necessary to strike a compromise for operation of the drive motor with regard to the rate of revolution.

Attempts have been made to dispose an additional independently driven dosing device above the inlet chute of the worm conveyor so that the amount of material introduced to the sifting basket is no longer dependent on the rate of revolution of the worm conveyor so that the sifting machine can be operated with the optimized rate of rotor revolution. The additional dosing device is however associated with significant additional constructional effort and also requires extra clearance height in the vicinity of the inlet chute. This is undesirable, since it makes the filling process more difficult.

Another possibility for avoiding the above mentioned disadvantages is to provide the worm conveyor, at least in its dosing region, with a larger core diameter or with a steeper conveyor screw pitch for reducing the amount transported. If appropriate, the worm conveyor can also be exchanged for a worm conveyor having differing geometry. All these measures, however, constitute unacceptable compromises in practical applications.

When the material being sifted by the sifting machine is changed, the sifting machine must normally be cleaned. Towards this end, the worm conveyor, the sifting basket and the rotor must be removed. This is also true when exchanging the sifting basket for a differing grain spectrum. Removal and exchange is however difficult and costly due to the relatively large axial constructional extent.

It is therefore the underlying purpose of the invention to create a sifting machine of the above mentioned kind with which the rotor and the worm conveyor can be operated at optimized rates of revolution and which facilitates a simplified cleaning and reconfiguration.

SUMMARY OF THE INVENTION

This purpose is achieved with a sifting machine of the above mentioned kind in that the worm conveyor and the rotor each have their own separate drive device.

Due to separation of the rotor drive from that of the worm conveyor, the rotor can be driven with a rate of revolution optimized for the material to be sifted and for the sifting action, whereas the input amount is adjustable by the worm conveyor drive device. In this manner, the additional clearance height for the dosing device disposed above the inlet chute is eliminated. In addition, the separate rotor and the worm conveyor drives facilitate directed removal of only those components necessary for reconfiguration or cleaning, wherein the axial constructional length of the individual components which are to be removed is reduced, since the shaft supporting the rotor is separate from the shaft bearing the worm conveyor.

A preferred configuration of the invention provides that the drive device for the rotor is disposed on that end thereof facing away from the worm conveyor. In this manner, the drive device installation is compact and coaxial configuration of the rotor and the worm conveyor is facilitated.

In order to remove the rotor as well as the sifting basket for cleaning or reconfiguration, a further improvement of the invention provides that the rotor, together with the sifting basket and its drive mechanism, can be axially pulled out of the sifting machine housing along a guiding mechanism. Towards this end, the rotor, the sifting basket, and the drive mechanism are conjoined, e.g. by means of an end lid of the sifting machine, into one single unit which, subsequent to release of appropriate locking mechanisms, can be pulled out of the housing by the axial extent of the sifting basket and the rotor so that the sifting basket and the rotor are freely accessible.

The guiding device preferentially includes at least one, preferentially however, two axis-parallel guiding rods introduced onto the unit comprising the rotor, the sifting basket and the drive mechanism, which are borne in a displaceable fashion in guides formed in the sifting machine housing.

In order to be able to more easily exchange the rotor and/or the sifting basket once they have been removed from the sifting machine housing, a preferred embodiment provides that the unit comprising the rotor, the sifting basket and the drive device is connected to the guide rods by means of a pivot bearing. After the sifting basket and the rotor have been pulled out of the sifting machine housing along their axial constructional length, the complete unit is pivoted about the pivot bearing to the side, so that the components are easily accessible. In particular, the rotor can be pulled axially out of the sifting basket and the sifting basket can be detached. In this manner, assembly space is reduced in the axial direction.

The pivot axis of the pivot bearing can be substantially perpendicular to the rotor axis and, in particular, extend in a vertical direction. It is, however, also possible for the pivot axis of the pivot bearing to coincide with the longitudinal axis of the guide rod.

The worm conveyor drive device is disposed on that end of the worm conveyor facing away from the rotor. This facilitates removal of the worm conveyor, extending within a worm conveyor housing, out of this housing together with the drive device to effect good accessibility for cleaning.

Further details and features of the invention can be extracted from the following description of embodiments with reference to the drawing.

DESCRIPTION OF THE PREFERRED EMBODIMENT

Figure 3:
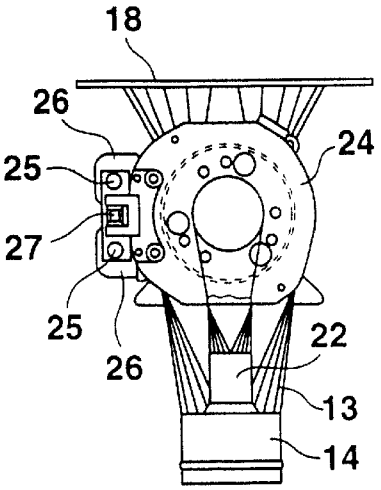
FIG. 3 shows the cut III—III in FIG. 1.
Figure 1:
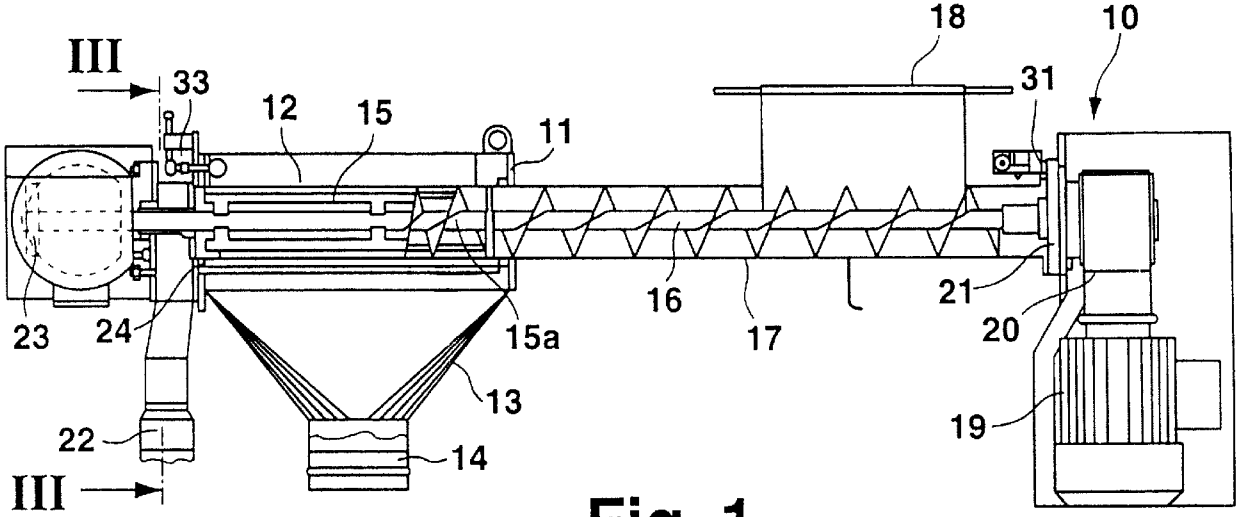
FIG. 1 shows sections of vertical cuts through a sifting machine.
Figure 2:
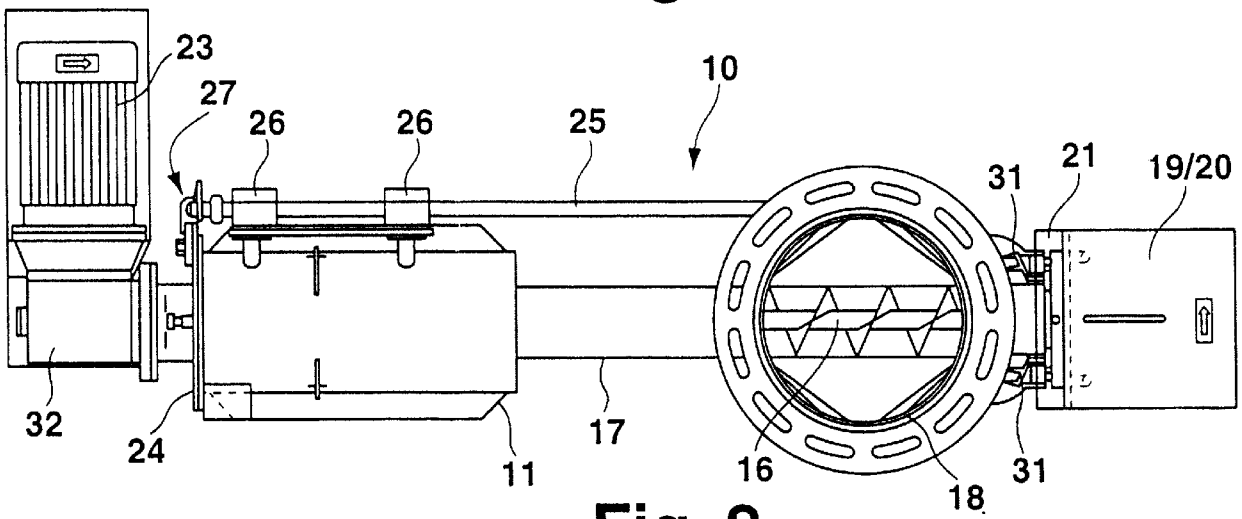
FIG. 2 shows a plan view of the sifting machine in accordance with FIG. 1.

A sifting machine 10, shown in FIGS. 1 through 3, has a tubular, horizontal worm conveyor housing 17 in which a worm conveyor 16 is borne for rotation. In FIG. 1, the left end of the worm conveyor housing 17 is fixed in a sifting machine housing 11 and a bearing plate 21 is disposed on the opposite right end which bears the worm conveyor 16 and which supports, on its outer side, a drive device in the form of an electrical motor 19 and a transmission 20. The bearing plate 21 is attached to the worm conveyor housing 17 by means of releasable locks 31. After release of the locks 31, the bearing plate 21 together with the motor 19, the transmission 20 and the worm conveyor 16 can be axially removed, as a unit, out of the worm conveyor housing 17 (towards the right in accordance with FIG. 1).

The worm conveyor housing 17 has an inlet chute 18 at its upper side by means of which the material to be sifted can be introduced in a conventional manner.

A rotor 15 is disposed within the sifting machine housing 11 and is coaxial with the worm conveyor 16, the rotor 15 being borne for rotation in a left-sided cover plate 24 which is disposed on that side of the rotor 15 facing away from the worm conveyor 16. An electrical motor 23 as well as a transmission 32 for the rotor 15 are attached to the outside of the cover plate 24.

The rotor 15 is surrounded by a tubular horizontal sifting basket 12 which is likewise borne by the cover plate 24. A receiving hopper 13 is formed at the lower side of the sifting machine housing 11 which maps at its lower side into an output conduit 14 for the sifted material. The inner region of the sifting basket 12 is connected, outside of the cover plate 24, to an additional outlet conduit 22 for the coarse product.

As shown in FIG. 1, the first end of the worm conveyor 16 projects by a small amount into the sifting basket 12. In addition, that end of the rotor 15 facing the worm conveyor 16 has two worm spirals 15*a* to effectively feed the material to be sifted to the sifting basket 12.

The cover plate 24 is fixed to the sifting machine housing 11 by means of detachable locks 33. After the locks 33 are released, the cover plate 24 together with the sifting basket 12 held thereby, the rotor 15 as well as the electric motor 23 and the transmission 32 can be axially pulled (in accordance with FIG. 1 towards the left, e.g. toward that side facing away from the worm conveyor 16) out of the sifting machine housing 11. The unit comprising the cover plate 24, the rotor 15, the sifting basket 12, the electric motor 23 and the transmission 32 is guided by a guiding device during removal. The guiding device comprises two guiding rods 25 borne on the cover plate 24 and extending parallel to the rotor axis at a separation from each other (FIG. 3) and having two associated guides 26 formed on the sifting machine housing 11. The two guide rods 25 are borne by a common vertical pivot axle 27 at the cover plate 24. This allows for sideward pivoting-out of the cover plate 24 and the components located thereon about the vertical pivot axle 27 after they have been pulled out of the sifting machine housing 11, so that the sifting basket 12 and the rotor 15 are easily accessible.

Figure 4:
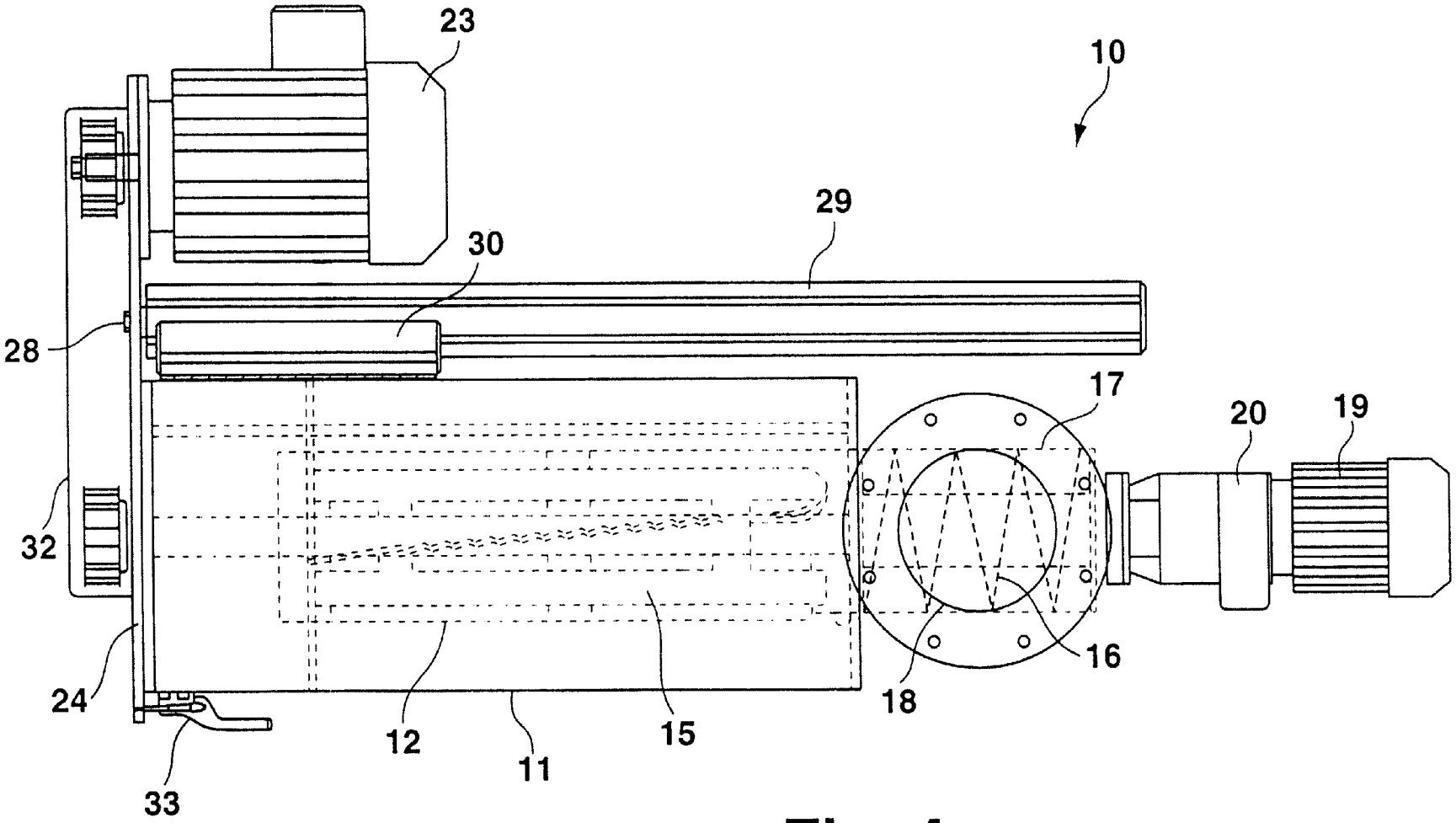
FIG. 4 shows a plan view of a sifting machine in accordance with an additional embodiment.

FIG. 4 shows an alternative configuration of a sifting machine, wherein components corresponding to the first embodiment have the same reference symbols. The substantial difference with regard to the embodiment in accordance with FIGS. 1 through 3 is that, in this case, only one single axis-parallel guide rod 29 is introduced on the cover plate 24, wherein the guide rod 29 extends in a guide 30 fashioned in the sifting machine housing 11. The guide rod 29 is held on the cover plate 24 by means of a horizontal pivot bearing 29, the pivot axis of which coincides with the longitudinal axis of the guide rod 29. After the sifting basket 12 and the rotor 15 have been axially removed from the sifting machine housing 11, they can be pivoted to the side about the horizontal pivot axis 28 by pivoting the cover plate 24 so that sufficient amount of space is available to remove the sifting basket in the opposite direction.

We claim:

1. A sifting machine for sifting material, comprising:

a sifting machine housing;

a stationary sifting basket mounted to said housing;

a rotor rotating within said sifting basket;

a worm conveyor feeding into an end of said sifting basket for dosing and introducing the material;

a rotor drive for rotating said rotor, said rotor drive being disposed at an end of said rotor facing away from said worm conveyor;

a worm conveyor drive for rotating said worm conveyors, and a guide device to axially pull said rotor, said sifting basket and said rotor drive out of said sifting machine housing.

2. The sifting machine of claim 1, further comprising means for connecting said rotor, said sifting basket, and said rotor drive to form a first unit, wherein said guide device comprises a guide rod member mounted to said first unit and a guide member formed on said sifting machine housing for bearing said guide rod member in a displaceable fashion.

3. The sifting machine of claim 2, wherein said guide rod member comprises two parallel guide rods.

4. The sifting machine of claim 2, further comprising a pivot bearing for connecting said first unit to said guide rod member.

5. The sifting machine of claim 4, wherein a pivot axis of said pivot bearing extends substantially perpendicular to an axis of said rotor.

6. The sifting machine of claim 4, wherein a pivot axis of said pivot bearing substantially coincides with a longitudinal axis of said guide rod member.

7. The sifting machine of claim 1, wherein said worm conveyor drive is disposed on an end of said worm conveyor facing away from said rotor.

8. The sifting machine of claim 1, further comprising a conveyor housing, wherein said worm conveyor extends within said conveyor housing, and further comprising means for releasably connecting said worm conveyor and said worm conveyor drive to said conveyor housing.

* * * * *